US009717321B2

(12) United States Patent
Eitan et al.

(10) Patent No.: US 9,717,321 B2
(45) Date of Patent: Aug. 1, 2017

(54) PADDED STRAP

(71) Applicant: Magpul Industries Corp., Boulder, CO (US)

(72) Inventors: Yehezkel Eitan, Johnstown, CO (US); William Bradley Bennett, Lafayette, CO (US); Kellen Cooper-Sansone, Denver, CO (US)

(73) Assignee: MAGPUL INDUSTRIES CORP., Austin, TX (US)

( * ) Notice: Subject to any disclaimer, the term of this patent is extended or adjusted under 35 U.S.C. 154(b) by 259 days.

(21) Appl. No.: 14/536,156

(22) Filed: Nov. 7, 2014

(65) Prior Publication Data

US 2016/0128452 A1 May 12, 2016

(51) Int. Cl.
*A45F 3/12* (2006.01)
*A45F 3/14* (2006.01)

(52) U.S. Cl.
CPC ..... *A45F 3/14* (2013.01); *A45F 3/12* (2013.01); *A45F 2003/142* (2013.01)

(58) Field of Classification Search
CPC ..... A45F 3/14; A45F 3/12; A45F 2003/142
See application file for complete search history.

(56) References Cited

U.S. PATENT DOCUMENTS 2,830,747 A 4/1958 Creste
3,964,653 A 6/1976 Strutz
4,311,263 A 1/1982 Bianchi
4,817,835 A 4/1989 Tarr
4,936,495 A 6/1990 Van de Pol
5,540,365 A 7/1996 LaMair
5,615,811 A 4/1997 Bell et al.
5,642,584 A 7/1997 Riggenbach
(Continued)

FOREIGN PATENT DOCUMENTS

CA 2871423 A1 12/2013
DE 202013105506 U1 3/2016
(Continued)

OTHER PUBLICATIONS

Allen, "Allen Signature Sling with Swivels Nylon and Neoprene Tan", webpage found at http://www.midwayusa.com/product/230347/allen-signature-sling-with-swivels-nylon-and-neoprene-tan downloaded on Oct. 16, 2015, p. 2, Published in: US.
(Continued)

*Primary Examiner* — Gary Elkins
(74) *Attorney, Agent, or Firm* — Neugeboren O'Dowd PC

(57) ABSTRACT

A padded strap is provided, which comprises a unitary strap member forming a tube and an inserted pad. The unitary strap member has at least two sections, at least one of the sections configured to form a pad casing section which can retain the inserted pad, and the another section comprising a substantially flat section abutting the pad casing section. The area between the pad casing section and the substantially flat section comprises a hollow, tapering transition area. The unitary strap member comprises at least one sealable opening at an end of the unitary strap member. The inserted pad is inserted through the sealable opening and retained in the pad casing section, and the pad is comprised of at least one outer layer of resilient, low-friction material and a cushioning layer.

18 Claims, 13 Drawing Sheets

(56) References Cited

U.S. PATENT DOCUMENTS

| | | | | |
|---|---|---|---|---|
| 5,695,102 | A | 12/1997 | Jackson | |
| 5,802,756 | A | 9/1998 | Hightower | |
| 5,806,733 | A | 9/1998 | Smith | |
| 6,217,063 | B1 | 4/2001 | Takeuchi | |
| 6,223,959 | B1 * | 5/2001 | Chen | A45F 3/12 224/264 |
| 6,279,795 | B1 | 8/2001 | Pierzina | |
| 6,530,129 | B1 * | 3/2003 | Cheng | A45F 3/14 206/315.5 |
| 6,647,656 | B2 | 11/2003 | Mazzagetti | |
| 6,932,254 | B2 | 8/2005 | Eliason | |
| 7,147,538 | B2 | 12/2006 | Cano | |
| 8,113,399 | B2 | 2/2012 | Lee | |
| 8,136,555 | B1 | 3/2012 | Chang et al. | |
| 8,807,405 | B2 * | 8/2014 | Crandall | A45F 3/12 2/268 |
| 8,857,680 | B1 | 10/2014 | Thompson | |
| 9,151,568 | B2 | 10/2015 | Belanger | |
| 9,157,700 | B1 | 10/2015 | Hansen | |
| 9,291,425 | B2 | 3/2016 | Golob et al. | |
| 2001/0052533 | A1 * | 12/2001 | Kubasik | A45C 13/30 224/643 |
| 2004/0060951 | A1 * | 4/2004 | Kelly | A45F 3/12 224/264 |
| 2004/0144816 | A1 * | 7/2004 | Ku | A41F 15/007 224/264 |
| 2005/0205620 | A1 * | 9/2005 | Yagisawa | A45F 3/14 224/159 |
| 2010/0093258 | A1 | 4/2010 | Glenn et al. | |
| 2011/0006088 | A1 | 1/2011 | Matthews | |
| 2011/0309118 | A1 * | 12/2011 | Wada | A45F 3/12 224/264 |
| 2012/0168470 | A1 | 7/2012 | Burton | |
| 2015/0076181 | A1 | 3/2015 | Seuk | |
| 2015/0369560 | A1 | 12/2015 | Chiang | |
| 2016/0123698 | A1 | 5/2016 | Gellert | |

FOREIGN PATENT DOCUMENTS

| | | | |
|---|---|---|---|
| EP | 2244048 | A1 | 10/2010 |
| EP | 2843353 | A2 | 3/2015 |

OTHER PUBLICATIONS

Allen, "Allen Signature Web & Neoprene Sling 8331", webpage found at http://www.opticsplanet.com/allen-signature-web-neoprene-sling.html downloaded on Oct. 16, 2015, p. 4, Published in: US.

Browning, "Browning Horsehair Sling Timber", webpage found at http://www.cabelas.com/product/Hunting/Hunting-Accessories/Gun-Slings%7C/pc/104791680/c/104734980/sc/104579280/Browning174-Horsehair-Sling-150-Timber/753256.uts?destination=%2Fcategory%2FGun-Slings%2F104579280.uts downloaded on Oct. 16, 2015, p. 1, Published in: US.

Browning, "Browning Leather Rio Lobo Sling 12260 12260", webpage http://www.opticsplanet.com/browning-leather-rio-lobo-sling-12260.html downloaded Oct. 16, 2015, p. 4, Published in: US.

Galco, "Galco Braided Cobra Rifle Sling RS7DH w/ Free Shipping and Handling", webpage found at http://www.opticsplanet.com/galco-braided-cobra-rifle-sling.html downloaded on Oct. 16, 2015, p. 4, Published in: US.

Limbsaver, "LimbSaver Kodiak Firearm/Crossbow Sling", webpage found at http://www.bowhunting.com/publisher/bow-accessories/2011/1/7/limbsaver-kodiak-firearmcrossbow-sling downloaded on Oct. 16, 2015, p. 3, Published in: US.

The Outdoor Connection, "Outdoor Connection Charger Rifle/Shotgun Sling", webpage found at http://www.opticsplanet.com/outdoor-connection-charger-sling.html downloaded on Oct. 16, 2015, p. 4, Published in: US.

Ruger, "Ruger Padded Leather Cobra Sling", webpage found at http://www.cabelas.com/product/Hunting/Hunting-Accessories/Gun-Slings%7C/pc/104791680/c/104734980/sc/104579280/Ruger-reg-Padded-Leather-Cobra-Sling/741490.uts?destination=%2Fcategory%2FGun-Sling%2F104579280.uts downloaded on Oct. 16, 2015, Published in: US.

Sigtac, "SigTac 1 Point Sling with Bungee and Snap Hook SLG-1P-BNGE-BLK", webpage found at http://www.opticsplanet.com/sigtac-1-point-sling-with-bungee-and-snap-hook.html downloaded on Oct. 16, 2015, p. 3, Published in: US.

SIMS Limbsaver, "Sims LimbSaver Kodiak Lite Slings", webpage found at http://www.cabelas.com/product/Hunting/Hunting-Accessories/Gun-Slings%7C/pc/104791680/c/104734980/sc/104579280/Sims-LimbSaverreg-Kodiak-Lite-Slings/1506381.uts?destination=%2Fcatalog%2Fbrowse%2Fgun-slings%2F__%2FN-1100129%2FNo-48%3FWTz__st%3DGuidedNav%26WTz__stype%3DGNP%26recordsPerPage%3D48 downloaded on Oct. 16, 2015, p. 1, Published in: US.

Tactical Assault Gear, "TAG Tactical Single Point Sling", webpage found at http://www.opticsplanet.com/tag-tactical-single-point-sling.html downloaded on Oct. 16, 2015, p. 3, Published in: US.

Troy, "Troy/VTAC Padded Sling", webpage found at http://www.cabelas.com/product/Hunting/Hunting-Accessories/Gun-Slings%7C/pc/104791680/c/104734980/sc/104579280/TroyVTAC-Padded-Sling/1379154.uts?destination=%2Fcatalog%2Fbrowse%2Fgun-slings%2F__%2FN-1100129%2FNo-48%3FWTz__st%3DGuidedNav%26WTz__stype%3DGNP%26recordsPerPage%3D48 downloaded on Oct. 16, 2015, p. 1, Published in: US.

Vanguard, "Vanguard 230C Gun Hugger Gun Sling—200g 336907", webpage found at http://www.opticsplanet.com/vanguard-230c-gun-hugger-gun-sling-200g.html downloaded on Oct. 16, 2015, p. 4, Published in: US.

Vickers Tactical, "Vickers Tacical M240 Sling", Webpage found at http://vickerstactical.com/larry-vickers-products/m240-sling/ Inventor(s) aware of prior art on or before Apr. 28, 2015, p. 5, Published in: US.

Blue Force Gear, "Vickers M249 SAW Sling", Webpage found at http://www.blueforcegear.com/vickers-combat-applications-sling-m249-saw-sling.html Inventor(s) aware of prior art on or before Apr. 28, 2015, p. 5, Published in: US.

Bravo Company USA, "Sling Swivel Mounts", Webpage found at http://www.bravocompanyusa.com/sling-swivel-mounts-s/63.htm Inventor(s) aware of prior art on or before Apr. 28, 2015, p. 4, Published in: US.

AREA51 Products LLC, "Blue Force Gear VCAS Vickers Sling Padded AA Model—Black", Webpage found at http://store.a51tactical.com/index.php?main_page=product_info&products_id=1967 Inventor(s) aware of prior art on or before Apr. 28, 2015, p. 2, Published in: US.

5.11 Tactical, "VTAC 2 Point Padded Sling", Webpage found at http://www.511tactical.com/vtac-2-point-padded-sling.html Inventor(s) aware of prior art on or before Apr. 28, 2015, p. 3, Published in: US.

Young, Lee W., "International Search Report and Written Opinion re Application No. PCT/US15/57069", Jan. 22, 2016, p. 11.

Dress Like a Girl, "Making Casing and Threading Elastic", Jul. 22, 2012, p. 1.

Baharlou, Simin, "International Preliminary Report on Patentability Re Application No. PCT/US2015/057069", May 9, 2017, pp. 8, Published in: CH.

* cited by examiner

PADDED STRAP

FIELD OF THE DISCLOSURE

The present invention relates to the field of straps and more particularly relates to a padded strap apparatus and a method of manufacturing thereof.

BACKGROUND

For nearly as long as humans have needed to carry objects of substantial weight with their shoulders, there have been straps and slings formed to carry those objects. To make them more comfortable, various types of these slings have been formed with some kind of padding. Slings have come in a variety of textiles that have varying degrees of strength and flexibility, including the many different kinds of fabrics, rubber, and leather. The padded portions of slings are often formed out of a different kind of material than the sling body itself, the padded material having been selected for its cushioning properties. No matter what kind of padded material is chosen, it must be affixed to the sling body in some way, such as by sliding, stitching, or insertion.

There are several known ways of adding padded material to a strap. One way is to construct a separate piece that slides onto the strap, wherein the strap is a unitary piece and the separate padded piece is threaded using some kind of serpentine pattern. This enables the pad itself to slide from one side of the strap to another. Examples of sliding pads can commonly be found on briefcase straps, which are typically padded with a soft material, or on athletic duffel bag straps, some of which are simply flat rubber pieces with gripping surfaces. An advantage to these sliding pads is that they are moveable to various places on the strap. A disadvantage is that they are easily snagged on other objects, such as the wearer's clothes, and their separate construction makes them susceptible to breaking, tearing, or otherwise separating from the actual strap. Further, the sliding motion of the pad is often not necessary, because users typically carry objects in similar ways every time, and therefore only need padding in one specific area of a strap. A strap manufacturer might simply manufacture a sliding pad for ease of manufacture rather than the necessity of the user.

Another way to add padded material to a sling or strap is to stitch it in a stationary manner to the outside of a section of the strap. When a padded material is added to the outside of a strap in this way, there is necessarily a transition area between the strap portion and the padded portion, often defined by stitching, a change in thickness, a change in material, a change in texture, or all of the above. The stationary location of the padded section on the sling may be preferable to a sliding pad, because it can reduce the snagging in comparison to a sliding pad, but the problems of snagging still exist, as does the likelihood of breaking or tearing at the transition area.

Another way to add padding to a sling or strap is to attach three separate pieces together in a linear fashion, with the first and the third of the pieces being the strap body and the middle piece being the padded section. These sections are typically stitched together or otherwise fused at their points of connection. Such stitching or fusing again creates the problems with snagging, and may make the entire sling even more susceptible to breaking or tearing because the joint may not be reinforced.

Yet another way to add padding to a sling is to insert the padded material into the strap material during manufacturing. This method is less common than the construction of the sliding pad or stitching a padded section onto the outside of a strap, perhaps because the manufacturing of an inserted pad poses several problems. For example, manufacturing may have to be done in layers to fit a pad in between two other sections of material, and the outer sections would still need to be fused together through stitching, gluing, or some other kind of bonding, which itself can be susceptible to breaking or tearing. Another way to insert a pad can be through a temporary or permanent hole in a section of the strap. Such a solution may also be problematic for several reasons. For example, a pad may not be as large as desired because it is limited by the size or placement of the hole. Additionally, it may be difficult to retain the desired shape of the padding within a section of the strap. Therefore, there exists a need to remedy the deficiencies in the prior art.

SUMMARY OF THE DISCLOSURE

In view of the foregoing disadvantages inherent in the known types of padded straps, this disclosure provides an improved padded strap.

To accomplish these objectives, this disclosure provides a padded strap. The padded strap can comprise a unitary strap member which forms a tube and an inserted pad. The unitary strap member can have at least two sections, at least one of the sections configured to form a pad casing section which can retain the inserted pad, and another section comprising a substantially flat section abutting the pad casing section. The area between the pad casing section and the substantially flat section may comprise a hollow, tapering transition area. Additionally, the unitary strap member can have a sealable opening at an end of the unitary strap member, through which the pad is inserted. The pad can be retained in the pad casing section. This pad may be comprised of an outer layer of resilient, low-friction material and a cushioning layer.

Another purpose of this disclosure is to provide a method of manufacturing a padded strap. The method can comprise constructing a unitary strap member which forms a tube with at least one pad casing section, at least one sealable opening, at least one substantially flat section, and a tapering transition area. The tapering transition area can be between the pad casing section and the substantially flat section. The method may also comprise assembling a pad comprising an outer layer of a resilient, low-friction material and a cushioning layer and then inserting the pad into the opening. The method may further comprise sliding the pad from the end of the opening into the pad casing section.

Yet another purpose of this disclosure is to provide a padded sling. The padded sling can comprise a unitary strap member which forms a tube and an inserted pad. The sling can have at least two sections, at least one of the sections configured to form a pad casing section which can retain the inserted pad, and another section comprising a substantially flat section abutting the pad casing section. The area between the pad casing section and the substantially flat section may comprise a hollow, tapering transition area. Additionally, the sling can have a sealable opening at an end of a strap within the sling, through which the pad is inserted. The pad can be retained in the pad casing section. This pad may comprise an outer layer of resilient, low-friction material and a cushioning layer.

Several features of the disclosure have thus been outlined in order that the more detailed description that follows may be better understood and in order that the present contribution to the art may better be appreciated. Additional features of the disclosure will be described hereinafter and will form the subject matter of the claims that follow.

Many objects of this disclosure will appear from the following description and appended claims, reference being made to the accompanying drawings forming a part of this specification wherein like reference characters designate corresponding parts in the several views.

Before explaining at least one embodiment of the disclosure in detail, it is to be understood that the disclosure is not limited in its application to the details of construction and the arrangements of the components set forth in the following description or illustrated in the drawings. The disclosure is capable of other embodiments and of being practiced and carried out in various ways. Also it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present disclosure. It is important, therefore, that the claims be regarded as including such equivalent constructions insofar as they do not depart from the spirit and scope of the present disclosure.

DETAILED DESCRIPTION

With reference now to the drawings, various embodiments of an accessory attachment are herein described. It should be noted that the articles "a", "an" and "the", as used in this specification, include plural referents unless the content clearly dictates otherwise.

Padded straps are used in a conjunction with a variety of articles that may be carried. Such articles include bags, briefcases, luggage, and firearms, to name a few examples. Though the benefits and advantages to the aspects of the present disclosure may be described in detail with reference to the carrying of the above-listed articles, these examples should not be construed to limit the scope of the disclosure. Indeed, aspects of the disclosure may pertain to wide-ranging applications that use padded straps for support or carrying of an article.

Figure 1:
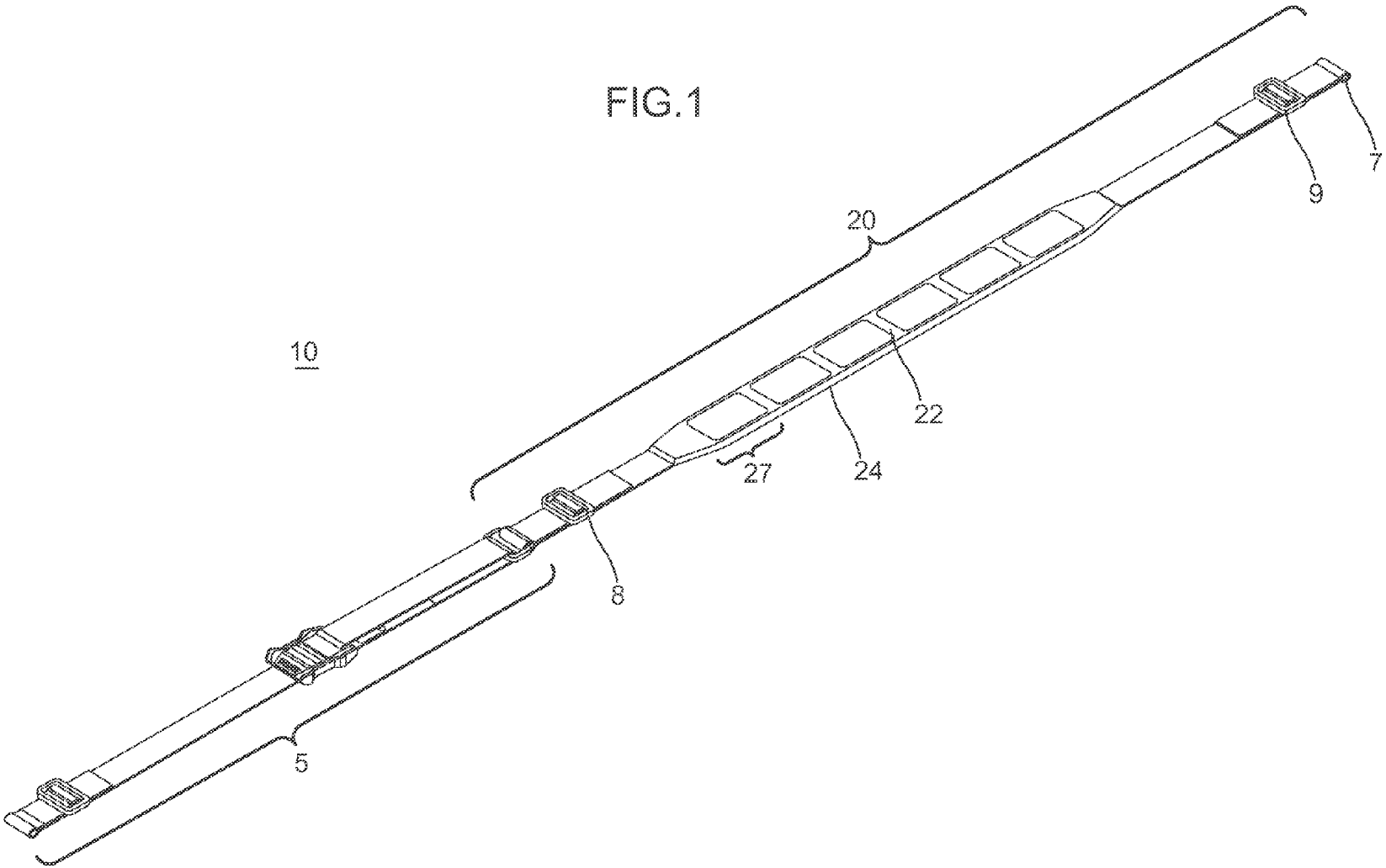
FIG. 1 is a top perspective view of a padded sling according to an embodiment of the present disclosure.

FIG. 1 shows an embodiment of the disclosure is depicted, in a top perspective view, in the context of an entire padded sling assembly 10. For the purposes of this disclosure, the discussion will center on strap member 20, with the acknowledgement that end sections 5 and 7 may comprise a variety of ends of slings that attach to articles. In the embodiment depicted, the strap member 20 is bound on each side by serpentine buckles 8 and 9, which are described merely for reference. Strap member 20 as depicted in this embodiment can include the portion of strap member 20 that passes through the serpentine buckles 8 and 9 and folds back on itself. It is to be understood that embodiments of strap member 20 may contain padded material of some sort, which may be referenced in the abstract and not numbered in all figures. Strap member 20 has a top side 22 and a bottom side 24. Strap member 20 in the embodiment depicted also has a stitching pattern 27, which will be described in more detail presently.

Figure 2:
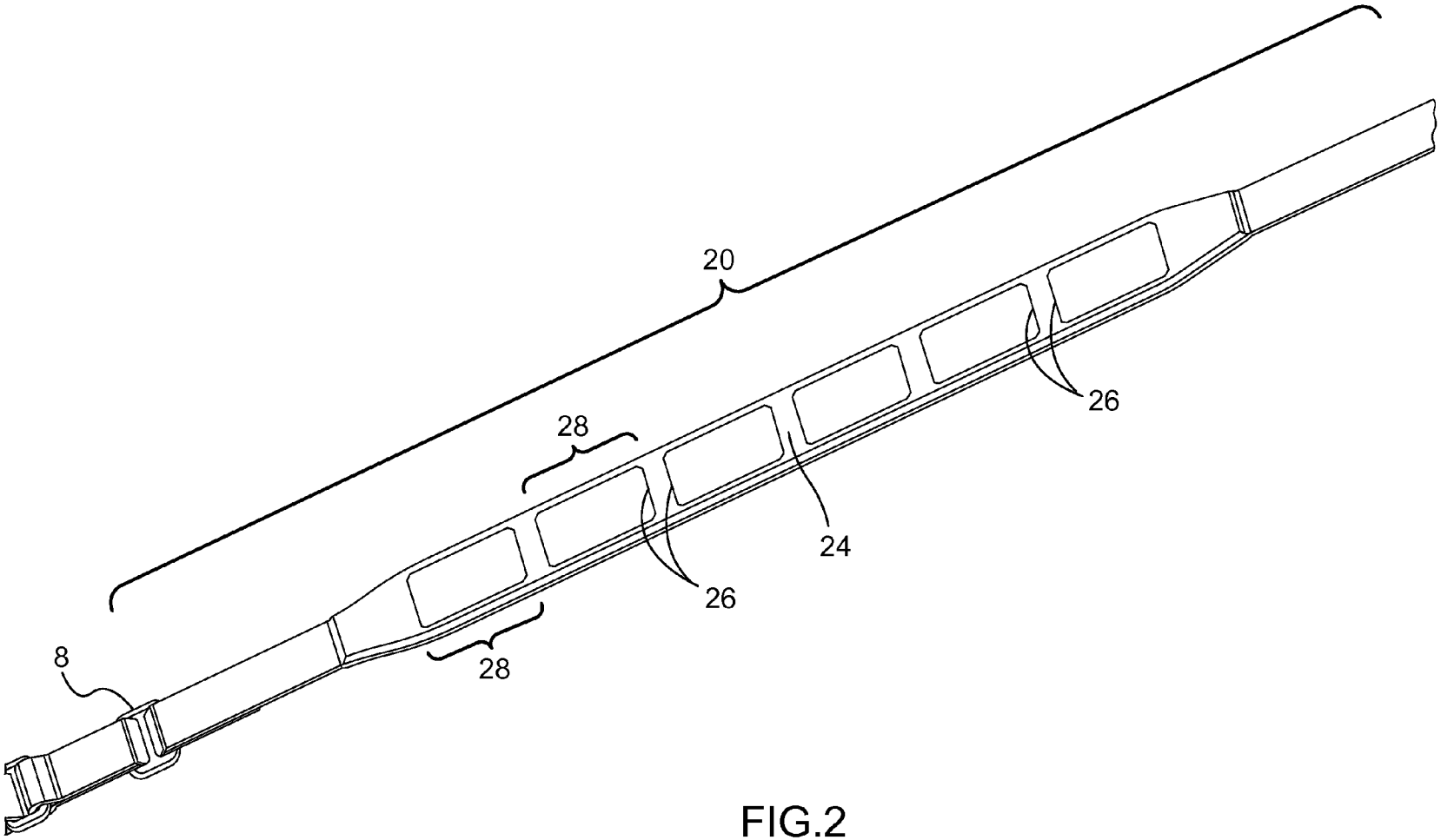
FIG. 2 is a bottom perspective view of the padded strap according to an embodiment of the present disclosure.

FIG. 2 shows a bottom perspective view of the strap member 20 as described and depicted in FIG. 1. The serpentine buckle 8 is upside-down in relation to its orientation in FIG. 1, which shows that the strap member 20 is also upside-down in relation to its orientation in FIG. 1, even though the two depictions of strap member 20 look similar in this embodiment. In FIG. 2, the bottom side 24 is now shown on top. It has a similar stitching pattern 28 which is the far side of the stitching pattern 27 depicted in FIG. 1. An advantage to having a stitching pattern 28 is that it can keep padded material in place. Various types of padded material will be described throughout this disclosure. However, in some embodiments, there may not be any stitching pattern at all. Many embodiments will have stitching patterns, though and it is contemplated, that the top and bottom of strap member 20 may look different from each other in some of those embodiments. For example, the bottom side 24 may have different stitching patterns, or stitching patterns may not be visible at all. The stitching pattern 28 in the embodiment shown is depicted as a rounded rectangle. There may be a plurality of such stitching patterns 28. In the embodiment depicted, there are six stitching patterns 28, each of which is a rounded rectangle. Each stitching pattern 28 as depicted in this embodiment has a transverse edge 26, which is transverse or substantially perpendicular to a longitudinal axis of the strap member 20. An advantage to having a transverse edge 26 is that the stitching that comprises it can compress padded material at the site of the transverse edge 26. If a particular pattern has multiple transverse edges 26, as in the embodiment depicted, padded material can be compressed at multiple points and more easily bend like joints. This can allow the strap member 20 to more easily bend and conform to a user's shoulder than if there were no transverse edges 26. In some embodiments, padded material within the strap member 20 may be sufficiently rigid that without transverse edges 26, the strap member 20 may not lay flat on a user's shoulder. It is contemplated that a variety of stitching patterns may have transverse edges 26 in order to create jointed effect on the padded material; for example, a set of stitched lines perpendicular to the longitudinal axis of the strap member could be used.

Figure 3:
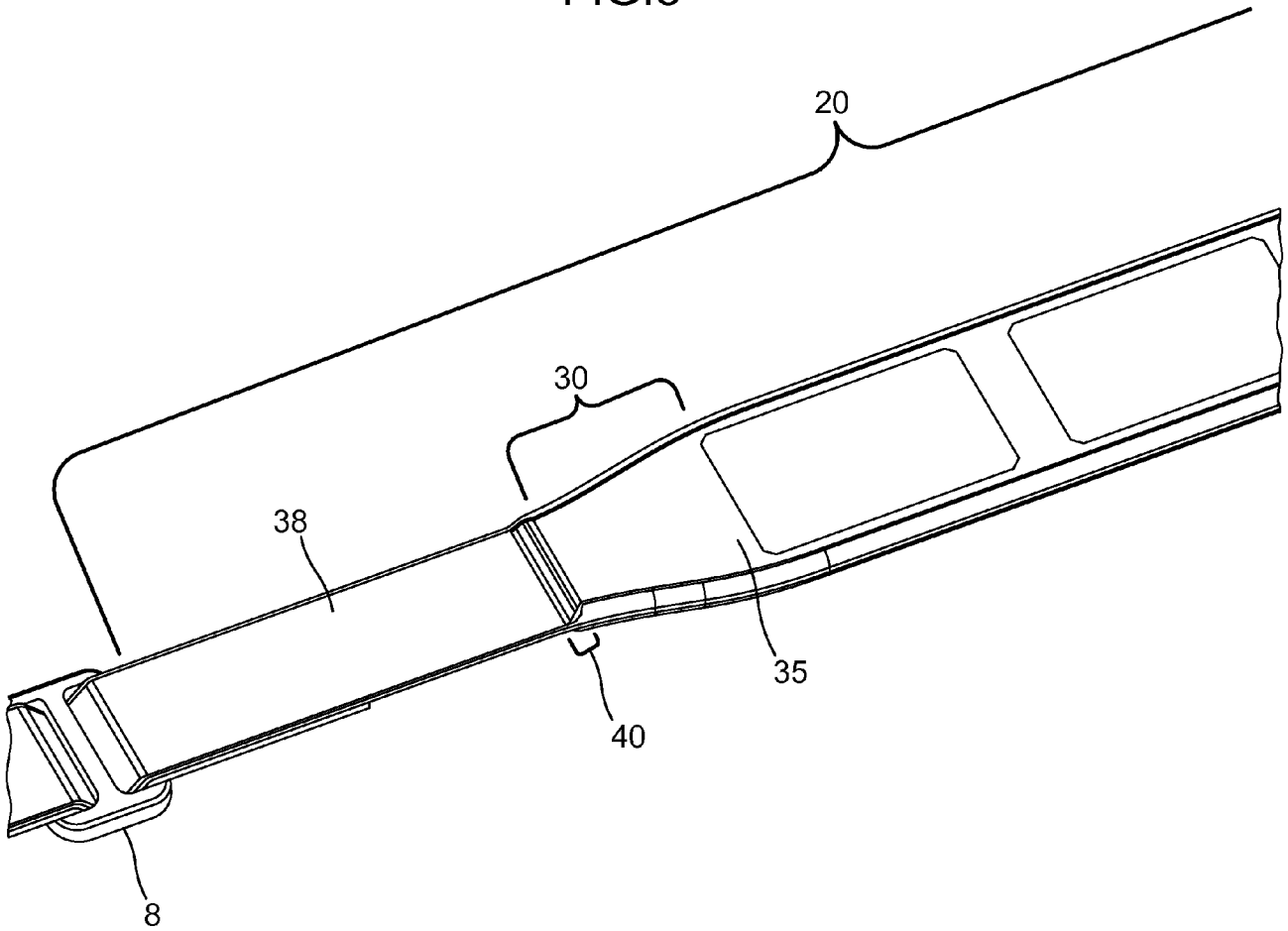
FIG. 3 is a perspective close-up view of the transition area between the pad casing section and the flat section of the padded strap.

FIG. 3 shows a close-up perspective view of the tapering section 30 and transition area 40 of the strap member 20. Transition area 40 depicts the change in thickness between pad casing section 35 and flat section 38. The strap member 20 in the embodiment depicted may be formed from a singularly woven, tapered, hollow, tubular fabric, the structure and formation of which will be described presently. The strap member 20, the pad casing section 35, and the flat section 38 may be formed by inserting a pad that is shorter in length than the entire strap member 20 into one end of the fabric and placing it substantially around a midpoint of the strap member 20. The placement of a pad can create the transition area 40 where the pad casing section 35 ends and the flat section 38 meet. The pad casing section 35 in this embodiment is thicker than the flat section 38. The depiction of the transition area 40 shows relief lines which illustrate the difference in thickness. In this embodiment, the relief lines do not represent any kind of stitching. Rather, the transition area 40 may be smooth. One advantage to having a smooth transition area with no stitching is that there is no surface upon which an article interacting with the transition area may snag. For example, if a user was wearing a sling with a transition area 40 as in this embodiment, and the user slid the sling along rough articles of clothing, the transition area 40 would not have stitching to snag.

FIG. 3 also depicts the tapering section 30 tapering from wide to narrow, moving from the pad casing section 35 to the flat section 38. An advantage to the shape of this tapering section 30 as depicted is that it also reduces the likelihood of snagging, but in a different way than transition area 40. The tapering section 30 creates a gradually widening (or narrowing, in the other direction) surface, which can be advantageous over a sudden change in width. For example, padded material that juts out at a right angle away from a non-padded area may get caught when sliding over a user's shoulder. The tapering section 30 is one way that allows an inserted pad to remain in the desired place, e.g., in the pad casing section 35. The hollow woven fabric of the strap member 20 can be woven such that the fabric that comprises the pad casing section 35 can contain a greater volume of material inside it than can the flat section 38. That is, if there were no pad within the pad casing section 35, the fabric surrounding pad casing section 35 would still retain a shape that is wider at pad casing section 35 and tapers to a narrow flat section 38. It is also contemplated that in some embodiments, the hollow woven fabric that comprises the strap assembly 20 can have some elastic properties, such that when there is no pad in the pad casing section 35, the entire strap assembly 20 would be substantially the same width throughout the entire length. That is, any tapering in the tapering section 30 would be created by the width of the actual inserted pad.

Figure 4A:
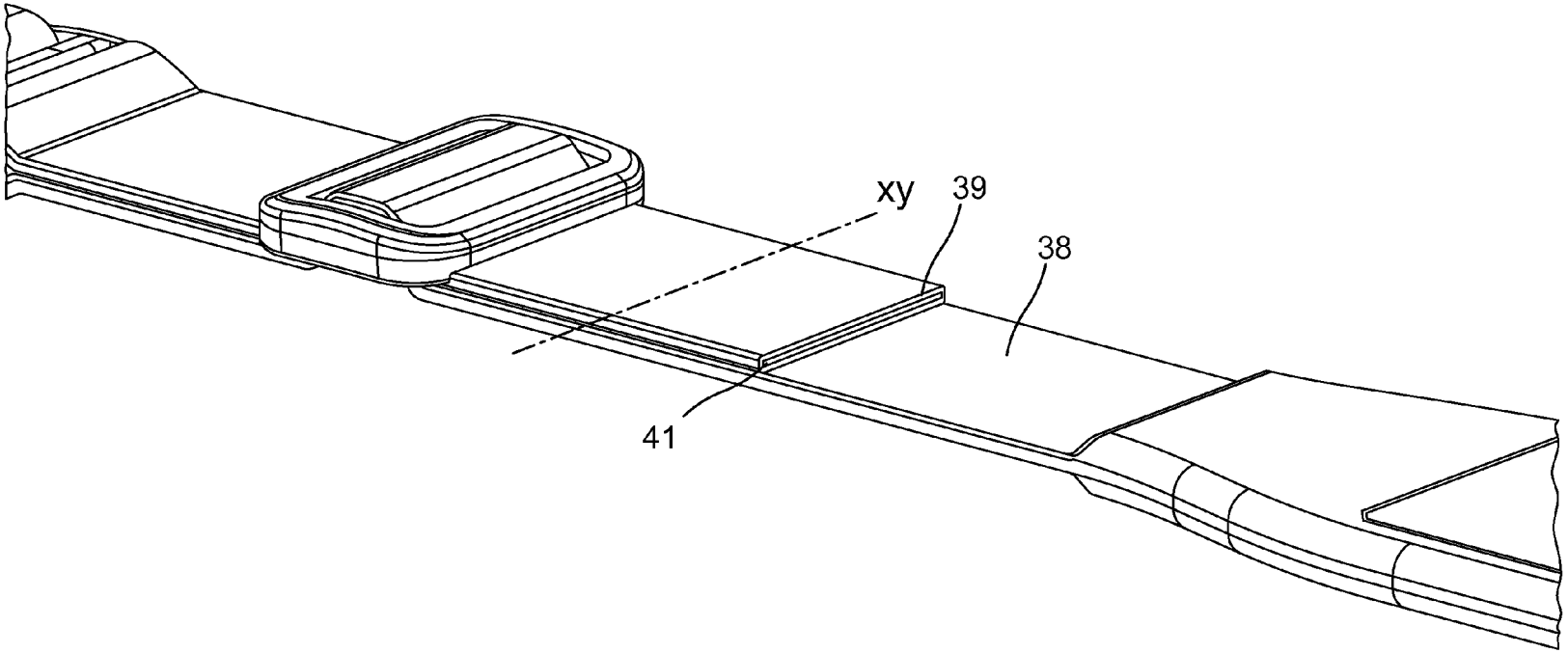
FIG. 4A is a perspective close-up view of the flat section and end of the padded strap.

Referring now to FIG. 4A, the flat section 38 is shown looped through the serpentine buckle 8. The end 39 of the flat section 38 is looped back on to the flat section 38. In the embodiment shown, the end 39 may comprise an opening of the hollow tubular fabric. There is a space 41 in the center of the end 38 which can be seen more clearly in FIG. 4B. In some embodiments, the end 39 comprises an opening through which a pad may be inserted. In the embodiment depicted, the end 39 may be glued, stitched, welded, heat-sealed, or otherwise closed. Though the end 39 is depicted on top of flat section 38, it is not attached to flat section 38. Rather, in this embodiment, the end 39 remains adjustable in length via the serpentine buckle 8. In other embodiments, the end 39 may be attached to the flat section 38 by gluing, stitching, etc. FIG. 4A also depicts the plane XY against which the cross-section of FIG. 4B is taken.

Figure 4B:
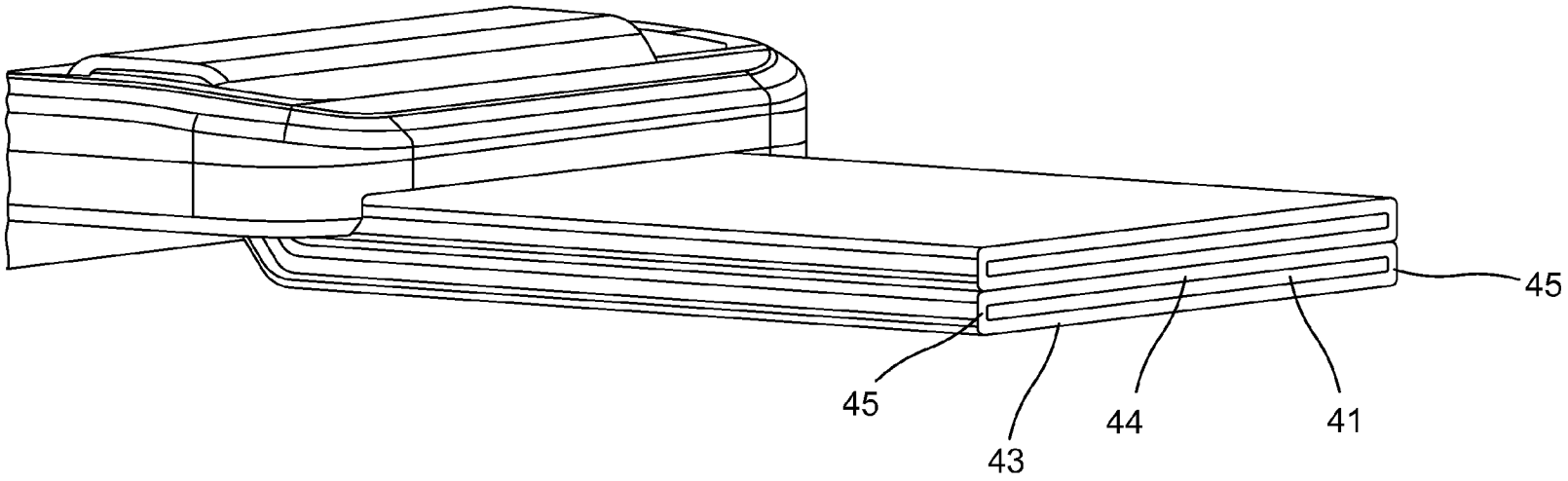
FIG. 4B is a cross-section view taken along the XY plane depicted in FIG. 4A.

FIG. 4B shows a cross section of the flat section 38 with the end 39 looped back over the flat section 38 as described in FIG. 4A. The flat section 38 has an upper surface 44 and lower surface 43, as well as edges 45, which together comprise the outer surface of a tube and surround a small empty space 41. Though the construction of the fabric is described as tubular, it is not necessarily circular; as seen in the depiction, the tubular fabric may lay in a substantially flat or rectangular configuration. Because fabrics are generally pliable, the tubular fabric may change shape depending on the given forces exerting pressure on it at any particular time. For example, the tubular fabric may stretch in sections through which a pad is inserted.

Figure 5:
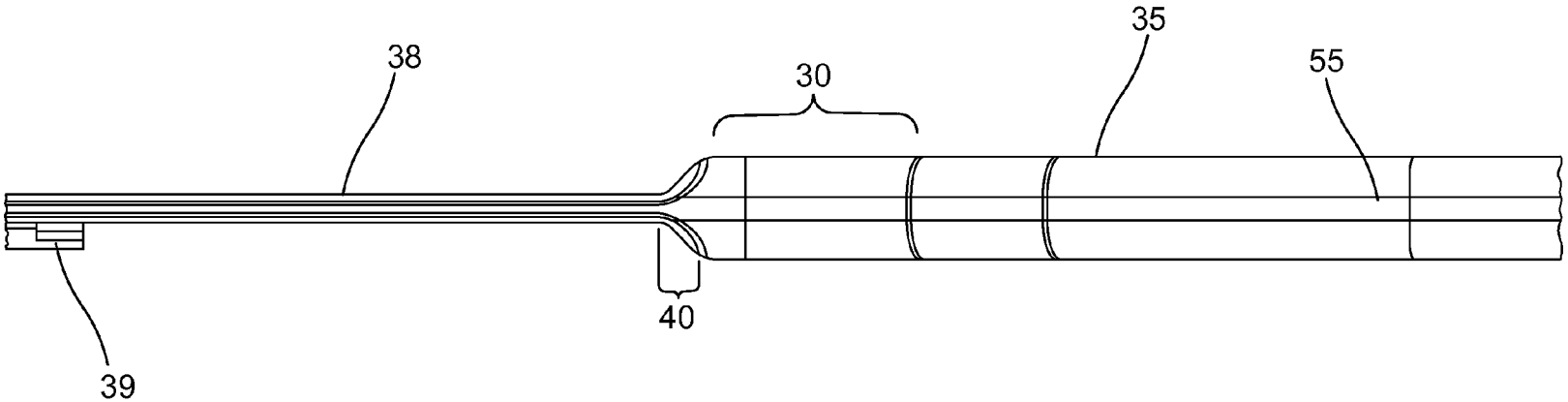
FIG. 5 is a side view of the padded strap.

FIG. 5 shows a side view of the transition area 40 as depicted in FIG. 4. Various relief lines are illustrated, but in this embodiment, the relief lines do not represent any kind of stitching. Tapering section 30 in this embodiment has a uniform thickness, which can be due to a uniform thickness in an inserted pad. The transition area 40 is created by an inserted pad that is thicker than the flat section 38. As a result, the strap assembly tapers in thickness at the transition area 40, in addition to tapering in width at the tapering section 30. This tapering in thickness is another way that can allow an inserted pad to remain in place.

Figure 5A:
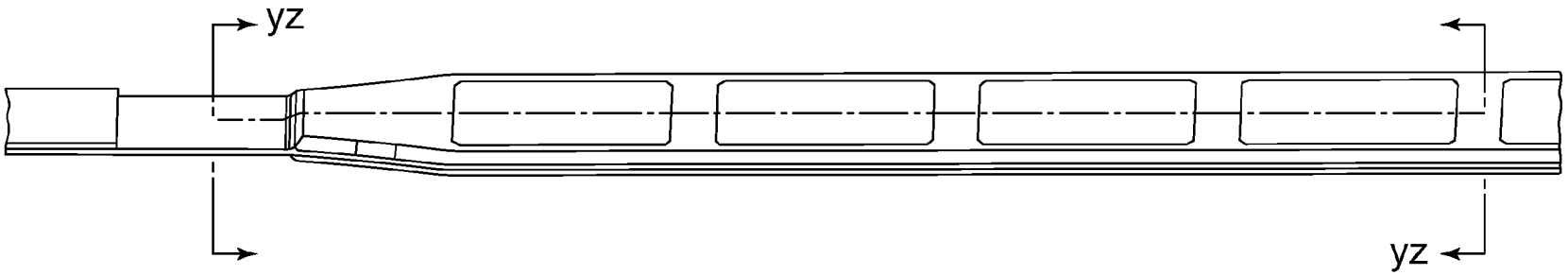
FIG. 5A is a top perspective view depicting the YZ plane along which the cross section of FIG. 5B is taken.
Figure 5B:
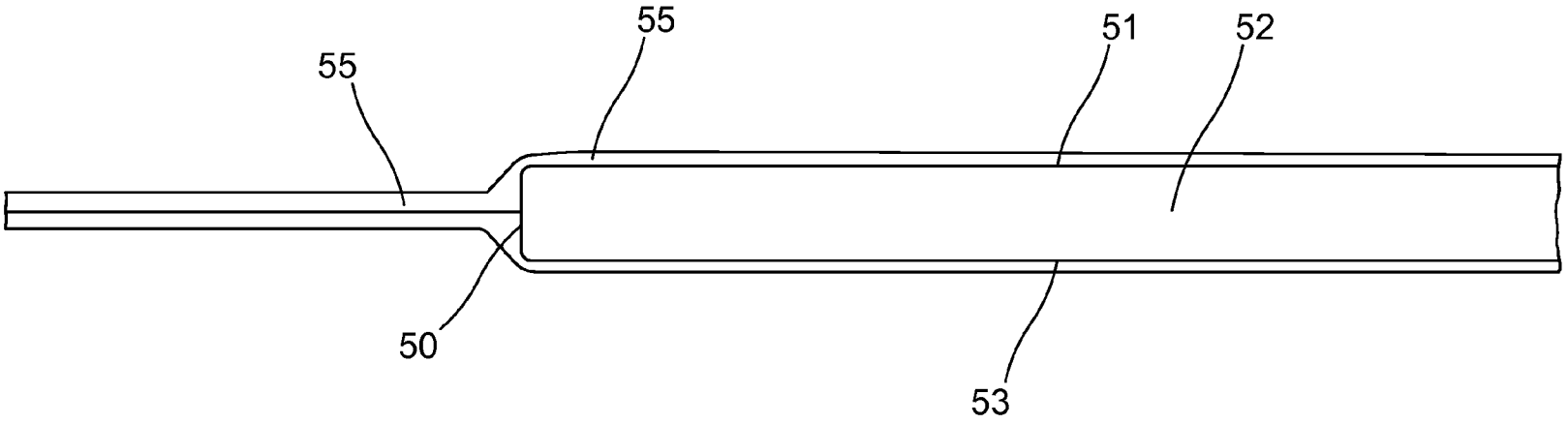
FIG. 5B is a cross-section view of the padded strap.

FIG. 5A is a top perspective view of the strap member 20, depicting the YZ plane against which the view of FIG. 5B is taken.

FIG. 5B shows a cross-section of the view in FIG. 5 taken along the cross-section as depicted in FIG. 5A. In the showing an inserted pad 50 within a strap material 55 of strap member 20. The strap material 55 may comprise a resilient polymeric or elastomeric woven, hollow, unitary fabric. An advantage to this kind of fabric is that it is durable, wear-resistant, and has the properties to allow weaving in this hollow, tapered fashion. It is contemplated that a variety of blended fabrics with the above-mentioned properties may be utilized in the construction of this strap member 20. Alternatively, other natural fibers, such as cotton, silk, or linen may be utilized. It is contemplated that any woven fabric may be used, but also that in certain embodiments the strap material 55 may comprise non-woven materials, such as vinyl. The inserted pad 50 in the embodiment shown may comprise three layers; a first layer 51, a middle layer 52, and a third layer 53. The first layer 51 and third layer 53 may comprise a resilient fabric with low-friction properties, such that the first layer 51 and third layer 53 are somewhat slippery. It is contemplated that the first layer 51 and third layer 53 may be one unitary outer layer. Additionally, this first layer 51 and third layer 53 may comprise a low-friction film or spray, such as a silicone spray.

The middle layer 52 may comprise a soft foam, or various other types of padding material that will be described presently. An advantage to using a thin slippery material to surround the foam middle layer 25 is that the inserted pad 50 may be pulled or pushed through an opening of the hollow tubular strap material 55. Many foam-type materials themselves have too much friction on their surfaces to allow them to slide against another fabric in a tight-fitting manner. That is, even if the strap material 55 itself was made of a low-friction material, an inserted pad made only of foam may create too much friction to be inserted. Many types of thin fabrics, including those made from natural and synthetic woven fibers, have sufficient low-friction properties to be suitable for the first layer 51 and third layer 53. Additionally, several types of thin films and sprays can provide the necessary low-friction properties. In embodiments where films or sprays are used, it is contemplated that the first layer 51 and third layer 53 may be visually imperceptible.

The middle layer 52 may comprise a variety of types of foam or other materials suitable for providing cushioning. For example, it may comprise low to high-density polyurethane foam or memory foam. It can also comprise multi-density foam. Several different types of foams mentioned herein may comprise one middle layer 52. Alternatively, soft fabrics, stuffing or filling materials, gels, liquids, or air may comprise the middle layer 52. Other contemplated cushioning materials for the middle layer 52 include non-Newtonian, shear-hardening fluids which harden in response to an impact.

Figure 6A:
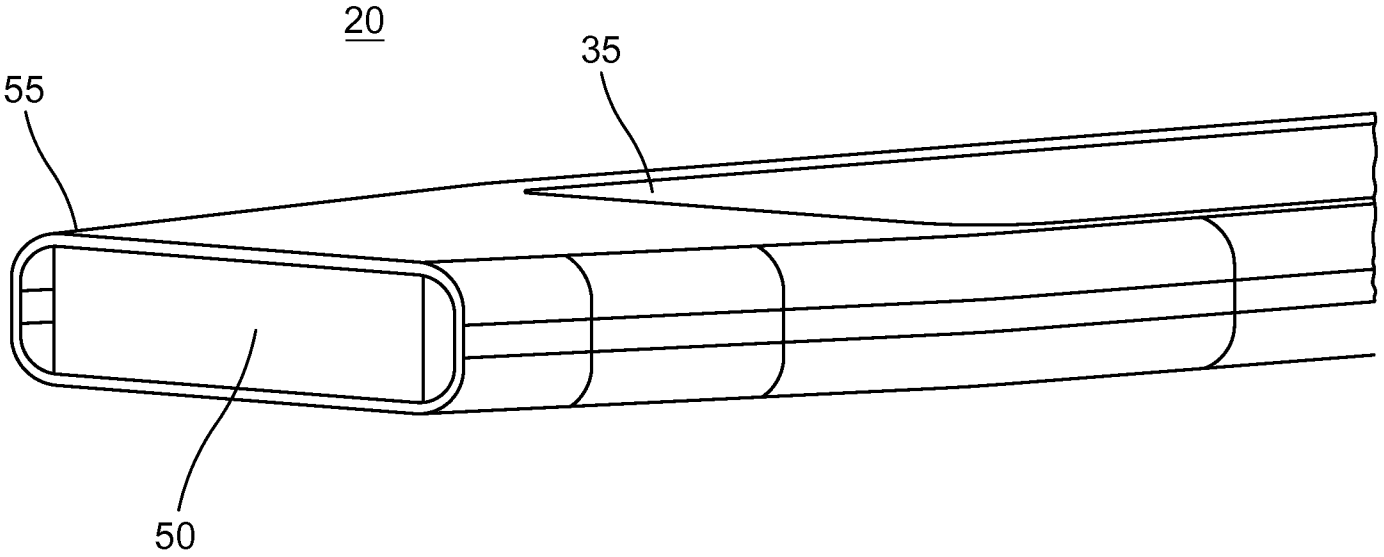
FIGS. 6A, 6B, 6C, and 6D are a series of cross-sectional views of the padded strap taken along a longitudinal axis of the strap.
Figure 6B:
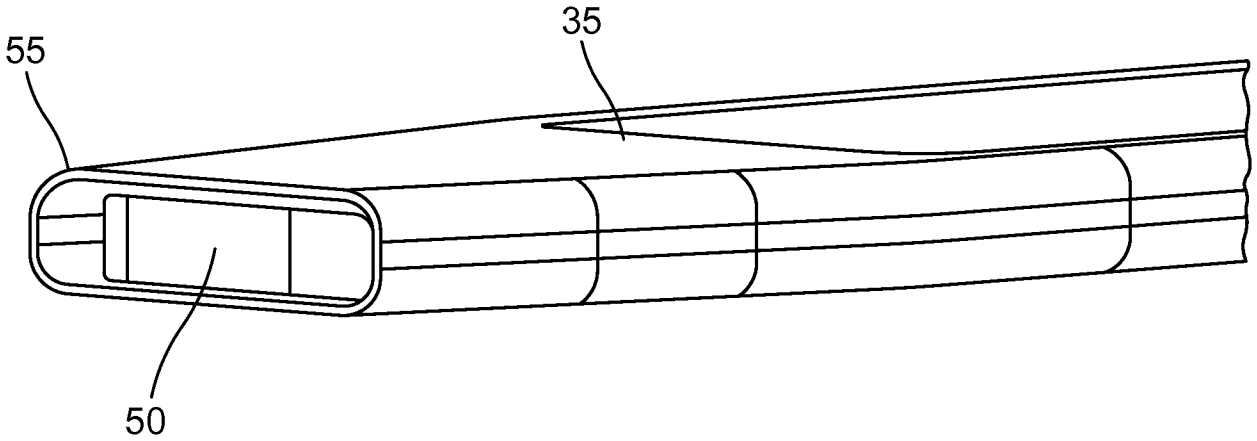
Figure 6C:
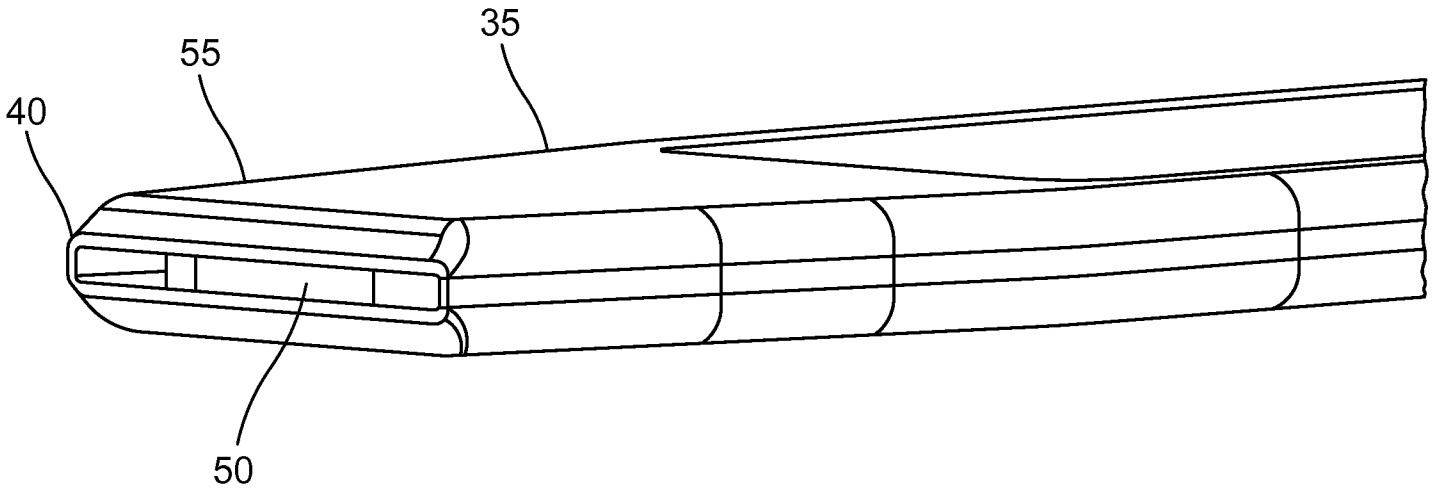
Figure 6D:
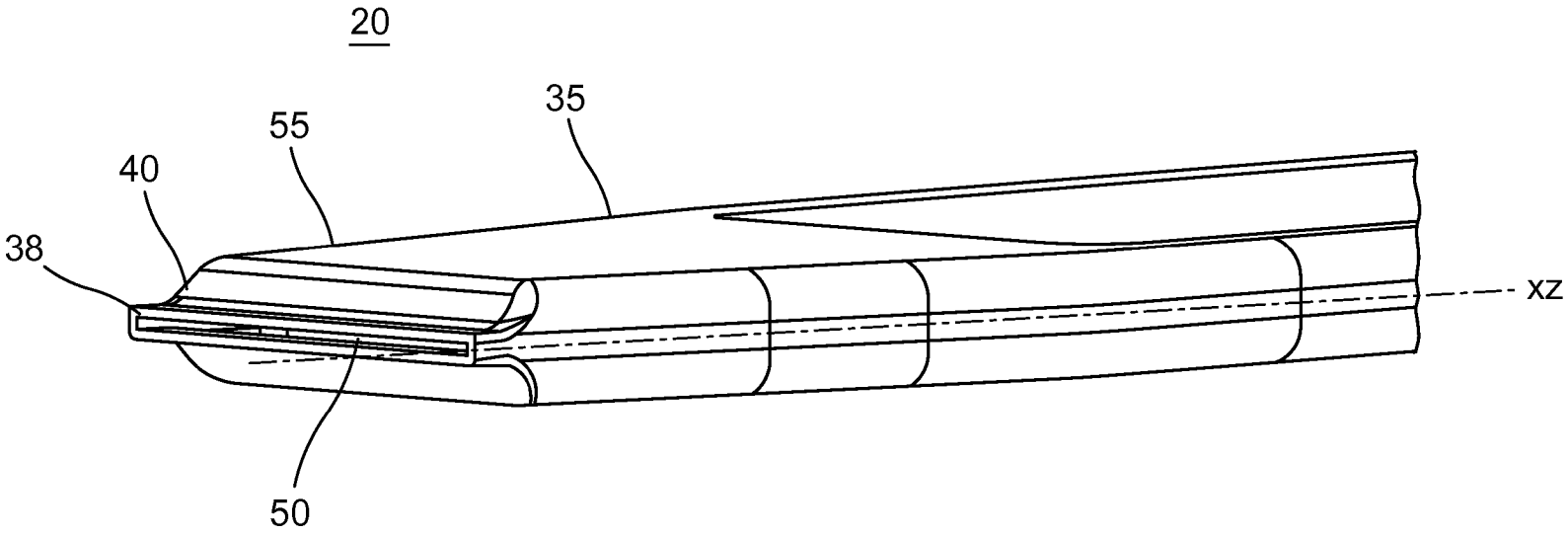

FIGS. 6A-6D show four different cross-sections of the strap member 20. Moving from the view in FIG. 6A, to 6B, to 6C, and then to 6D, the cross-sections are taken in an order and direction moving from the pad casing section 35 to the flat section 38 (visible only in FIG. 6D). This series of figures illustrates that the inserted pad 50 is shaped to taper in width from its widest point in FIG. 6A to its end, visible in FIG. 6C. It also shows that the strap material 55 remains hollow and tubular, and is unitarily constructed, as it tapers from its wider configuration of the pad casing section 35, to the narrow configuration of the flat area 38. As shown in FIG. 6C, transition area 40 becomes visible, and as depicted, it is hollow as well. FIG. 6D shows the transition area 40 completing its transition to the flat section 38, which is also hollow. The hollow transition area 40 is a feature of the strap fabric 55 itself, and may not require any stitching. There are several advantages to this construction. First, the inserted pad 50 may be inserted through the end 39 (as shown in FIG. 4A, for example, before the end 39 is eventually attached to any other point or sealed. The inserted pad 50 may pass through the flat section 38 before being positioned in the pad casing section 35. This eliminates a need for stitching two or more layers of fabric together around a pad, which provides less snagging and greater durability. This construction also provides the benefit of securing a pad in place. In some embodiments, it is contemplated that the fit of the inserted pad within the pad casing section 35 will be so tight that no additional stitching is necessary, even at any midpoints of the pad (though some such midpoint stitching is depicted in the embodiment shown). Additionally, the construction of the transition area 40 as depicted provides the benefit of a smooth outer surface which may glide easily against a user's shoulder without getting snagged.

Figure 7:
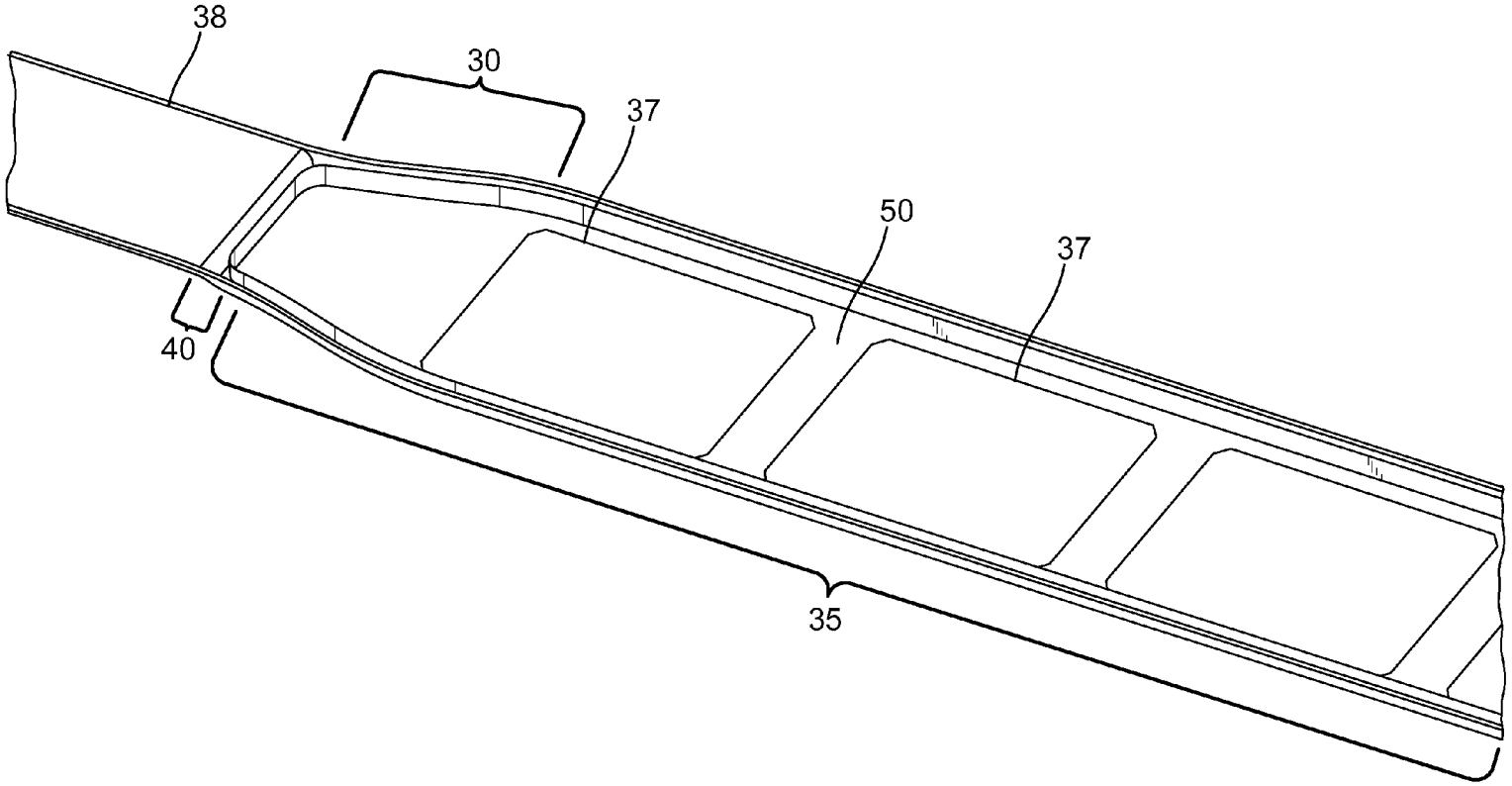
FIG. 7 is a cross-section view of the padded strap, taken along the XZ plane as depicted in FIG. 6D.

FIG. 7 shows a cross-section perspective view of the top of the pad casing section 35. The cross-section is taken along the XZ plane as depicted in FIG. 6D. Strap member 20 is shown cut down a midline, so the middle layer 52, comprised of foam, is exposed. The inserted pad 50 can be formed in a substantially exact shape to minor the interior shape of the pad casing section 35. An advantage to forming the inserted pad 50 in substantially the same shape as the pad casing section 35 of the strap member 20 is that once the inserted pad 50 is in place, it may be retained in place solely by the shape of the pad casing section 35. In embodiments where the inserted pad 50 is formed in the shape of the pad casing section, the inserted pad may taper in width in alignment with the tapering section 30 of the pad casing section 35. As seen in FIG. 5B, though, the inserted pad 50 may retain substantially the same thickness throughout its length. It is contemplated that in other embodiments, the inserted pad 50 may have varying degrees of thickness throughout its length. For example, the inserted pad 50 may be thicker in the middle than at either end.

Additionally, FIG. 7 shows that in the embodiment depicted, the inserted pad 50 is secured by internal stitches 37. Referring briefly back to FIGS. 1 and 2, rounded rectangular stitching patterns 27 and 28 are depicted on the outsides of the pad casing section 35. In the embodiment depicted, the stitching patterns 27 and 28 represent stitches that have passed from one side of the pad casing section 35 to the other, and internal stitches 37 represent the same stitches which form stitching patterns 27 and 28. As described earlier, such stitching patterns can create joints that facilitate the bending of the inserted pad section 50. An advantage to placing the stitching patterns 27 and 28 as depicted, away from the two ends of the inserted pad 50, is that the stitches can keep the inserted pad 50 from moving within the pad casing section 50 once inserted. An advantage over placing the stitching at the two ends of the inserted pad 50, or around its perimeter, is that the stitches in the middle are less likely to be snagged on articles of clothing.

An embodiment of the disclosure is a method of manufacturing, some steps of which have been described or made apparent in the discussion accompanying the above drawings. A method may include assembling a pad to be inserted. The pad may have an outer layer, or multiple outer layers, of a material that would allow the pad to slide easily against a tightly fitted fabric tube, such as the strap material 55 as described herein. The pad may have a middle layer of a foam or other padded substance selected for its cushioning properties. Such a layer may comprise a gel or other liquid, or may comprise a harder material than traditional foams used for padding, or any other materials described throughout this disclosure.

The method may also comprise weaving a strap member 20 as described herein out of threadable material, such as nylon, polymers, poly blends, cotton, silk, etc. Such weaving may be done by a loom such as a French loom which is capable of weaving a transition area 40 as described herein. Alternatively, the strap member 20 may be manufactured from a non-woven material, such as vinyl, plastic, rubber, polymeric, or elastomeric materials. The method may further comprise inserting the assembled pad into an end of the strap member and through the flat section 38. This may be done by folding, rolling, or otherwise compressing the assembled inserted pad 50. The inserted pad 50 may be pulled or pushed manually or by a machine. Alternatively, the inserted pad may be led and pulled through using another opening, such as an opening at the opposite end of the strap assembly 20. For example, a method may include inserting a lead, such as a wire or a cord, through one opening at an end 39 of the strap assembly 20, which runs all the way through to the other end 39. One type of lead material that can be suitable for this method is paracord, which is also commonly known in the art as 550 cord. Then the method may include attaching the lead to the assembled inserted pad 50, and then pulling the assembled inserted pad 50 in through the flat section 38 and positioning the assembled inserted pad 50 into the pad casing section 35. This pulling may be accomplished manually or by a machine process as well. Alternatively, vacuum suction methods could be used to pull or draw the assembled inserted pad 50 into place within the pad casing section 35. Finally, the method may include stitching portions of the pad casing section 35 to the inserted pad 50. The stitching may be done by machine or by hand. The stitching may permeate only one side of the strap fabric 55 and inserted pad 50, or it may permeate all the way through to both sides of the strap fabric 55 that surrounds the inserted pad 50.

What is claimed is:

1. A padded strap comprising;

a tubular strap member, formed from a single piece of woven fabric, and;

an inserted pad;

the tubular strap member having at least two sections, at least one of the sections configured to form a pad casing section which can retain the inserted pad;

the at least one other section comprising a substantially flat section abutting the pad casing section, wherein an area between the pad casing section and the substantially flat section comprises a hollow transition area that tapers in thickness and width;

the tubular strap member comprising an opening at each end of the tubular strap member;

wherein the inserted pad is wider than the substantially flat section when retained in the pad casing section, and no retaining stitching exists on the tubular strap member immediately outside either end of the inserted pad, and;

wherein the inserted pad is comprised of:

at least one outer layer of resilient, low-friction material that covers the entire surface of the inserted pad and which remains in contact with an inside of the tubular strap member;

and a cushioning layer entirely inside the at least one outer layer.

2. The padded strap of claim 1, wherein the resilient, low-friction material comprises a spray.

3. The padded strap of claim 1, further comprising one pad casing section between two substantially flat sections.

4. The padded strap of claim 1, wherein the inserted pad comprises two ends, and the inserted pad is secured within the pad casing section by stitching at one or more points between the two ends.

5. The padded strap of claim 3, wherein each of the two substantially flat sections terminates in an opening.

6. A method of manufacturing a padded strap, the method comprising;

constructing a tubular strap member from a single piece of woven fabric with at least one pad casing section configured to retain a pad within the pad casing section, at least one substantially flat section terminating in a sealable opening, and a tapering transition area between the at least one pad casing section and the at least one substantially flat section that tapers in thickness and width;

assembling the pad such that it comprises at least one outer layer of a resilient, low-friction material that covers the entire surface of the pad and a cushioning layer and is wider than the substantially flat section of the tubular strap member;

inserting the pad into the sealable opening before the sealable opening is sealed;

sliding the pad from the end of the at least one sealable opening into the at least one pad casing section.

7. The method of claim 6, further comprising the unitary strap member having two sealable openings, one at each end of the strap;

wherein sliding comprises;

threading a lead through both openings, attaching the lead to the pad, using the lead to pull the pad through one of the sealable openings of the strap through the substantially flat section with the resilient, low-friction material in contact with an inside of the substantially flat section the entire time the pad is being pulled through the substantially flat section, and, positioning the pad within the pad casing section such that the pad is retained within the pad casing section.

8. The method of claim 6, wherein assembling the pad comprises spraying the layer of resilient, low-friction material onto the cushioning layer.

9. The method of claim 6, further comprising:

stitching the pad to the pad casing section at one or more midpoints of the pad once the pad is positioned within the pad casing section.

10. The method of claim 6, further comprising attaching the at least one opening to a fixture.

11. A padded sling, comprising;

a tubular strap member, formed from a single piece of woven fabric, and;

an inserted pad;

the tubular strap member having at least two sections, at least one of the sections configured to form a pad casing section which can retain the inserted pad;

the at least one other section comprising a substantially flat section abutting the pad casing section, wherein an area between the pad casing section and the substantially flat section comprises a hollow transition area that tapers in thickness and width;

the tubular strap member comprising an opening at each end of the tubular strap member;

wherein the inserted pad is wider than the substantially flat section when retained in the pad casing section, and no retaining stitching exists on the tubular strap member immediately outside either end of the inserted pad, and;

wherein the inserted pad is comprised of:

at least one outer layer of resilient, low-friction material that covers the entire surface of the inserted pad and which remains in contact with an inside of the tubular strap member;

and a cushioning layer entirely inside the at least one outer layer.

12. The padded sling of claim 11, further comprising one pad casing section between two substantially flat sections.

13. The padded sling of claim 12, wherein each of the two substantially flat sections terminates in an end with an opening.

14. The padded sling of claim 13, wherein each end is attached to a buckle.

15. The padded sling of claim 11, wherein the sling is attached to one selected from the group of a firearm, luggage, a briefcase, or a backpack.

16. The padded sling of claim 11, wherein the outer layers of resilient, low-friction material comprises a spray.

17. The padded sling of claim 11, wherein the cushioning layer comprises a foam.

18. A padded strap comprising;

a tubular strap member, formed from a single piece of woven fabric; and an inserted pad;

the tubular strap member having at least two sections, at least one of the sections configured to form a pad casing section which can retain the inserted pad;

the least one other section comprising a substantially flat section abutting the pad casing section, wherein an area between the pad casing section and the substantially flat section comprises a hollow transition area that tapers in thickness and width;

the tubular strap member comprising an opening at each end of the tubular strap member;

wherein the inserted pad is wider than the substantially flat section when retained in the pad casing section, and no retaining stitching exists on the tubular strap member immediately outside either end of the inserted pad, and;

wherein the inserted pad is comprised of:

at least one outer layer of resilient, low-friction material that covers the entire surface of the inserted pad and which remains in contact with an inside of the tubular strap member;

and a cushioning layer entirely inside the at least one outer layer.

* * * * *